US012203363B2

(12) United States Patent
Al-Baiyat

(10) Patent No.: US 12,203,363 B2
(45) Date of Patent: Jan. 21, 2025

(54) SMART DEVICE, SYSTEM, AND METHOD FOR DIAGNOSING CASING-CASING ANNULUS (CCA) BEHAVIOR

(71) Applicant: SAUDI ARABIAN OIL COMPANY, Dhahran (SA)

(72) Inventor: Islam Ali Al-Baiyat, Qatif (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 405 days.

(21) Appl. No.: 17/451,347

(22) Filed: Oct. 19, 2021

(65) Prior Publication Data

US 2023/0121277 A1 Apr. 20, 2023

(51) Int. Cl.
*E21B 47/12* (2012.01)
*E21B 47/117* (2012.01)

(52) U.S. Cl.
CPC ..... *E21B 47/12* (2013.01); *E21B 47/117* (2020.05); *E21B 2200/22* (2020.05)

(58) Field of Classification Search
CPC .... E21B 2200/22; E21B 47/005; E21B 47/07; E21B 47/117; E21B 47/12
See application file for complete search history.

(56) References Cited

U.S. PATENT DOCUMENTS

| | | | |
|---|---|---|---|
| 4,727,489 | A | 2/1988 | Frazier et al. |
| 7,438,128 | B2 | 10/2008 | Drozd et al. |
| 2011/0188346 | A1 | 8/2011 | Hull |

(Continued)

FOREIGN PATENT DOCUMENTS

| | | | |
|---|---|---|---|
| AU | 2013375225 | B2 | 1/2016 |
| CN | 108131130 | A | 6/2018 |

(Continued)

OTHER PUBLICATIONS

Srivastava, Manish et al., "A Systematic Approach to Monitoring and Management of Annulus Pressures"; Proceedings of the SPE/IADC Middle East Drilling Technology Conference and Exhibition; Paper No. SPE-189412-MS; pp. 1-11; Jan. 29-31, 2018 (11 pages).

(Continued)

*Primary Examiner* — Daniel P Stephenson
(74) *Attorney, Agent, or Firm* — Osha Bergman Watanabe & Burton LLP

(57) ABSTRACT

A smart device located in a wellbore head during production operations in a well is disclosed. The smart device has a transceiver that exchanges signals with a wellhead sensor, the wellhead sensor monitoring a hydraulic line with T-connection for bleed-off. The transceiver communicates with the wellhead sensor through a first communication link established by the smart device. A localization system identifies pressure information relating to information of the well, including sizes of an inner casing and of an outer casing of the well, and a processor implements a combination of artificial intelligence and machine learning to preemptively provide warnings relating to possible estimated CCA behavior. Report information is generated that includes whether a source from a bleed-off is downhole or from trapped compressed fluid due to heat expansion, and provides a forward plan for a remedial job based on previous history of similar CCA behavior in the well.

9 Claims, 7 Drawing Sheets

(56) References Cited

U.S. PATENT DOCUMENTS

| | | | | |
|---|---|---|---|---|
| 2020/0048999 | A1* | 2/2020 | Langnes | E21B 47/107 |
| 2022/0011464 | A1* | 1/2022 | Alali | G01K 11/32 |
| 2023/0080453 | A1* | 3/2023 | Idris | E21B 47/06 166/250.01 |
| 2023/0121277 | A1* | 4/2023 | Al-Baiyat | E21B 47/117 166/250.01 |
| 2023/0123032 | A1* | 4/2023 | Al-Dhafeeri | E21B 47/06 166/250.07 |
| 2023/0228186 | A1* | 7/2023 | Al-Dhafeeri | E21B 49/008 166/91.1 |

FOREIGN PATENT DOCUMENTS

| | | | |
|---|---|---|---|
| WO | 2015/153823 | A1 | 10/2015 |
| WO | 2016/022069 | A2 | 2/2016 |

OTHER PUBLICATIONS

Mohamed, I. M. et al., "Evaluation of Annulus Pressure Buildup During Injection Operations"; Journal of Energy Resources Technology; vol. 143, Issue 7, Article 073002; pp. 1-9; Jul. 2021 (9 pages).

* cited by examiner

SMART DEVICE, SYSTEM, AND METHOD FOR DIAGNOSING CASING-CASING ANNULUS (CCA) BEHAVIOR

BACKGROUND

Casing-Casing Annulus (CCA) Pressure is a type of issue in a well where there is a pressure developed in the wellhead side-outlet valve. This pressure may be from various sources, such as the reservoir itself or trapped compressed fluid in the annulus. In cases where CCA issues are developed, communication in-between casings occurs when there are cement failures due to micro-channeling or micro-annulus.

SUMMARY

In general, one or more embodiments disclose a smart device included in a smart system located in a wellbore head during production operations in a well. The smart device has a transceiver that exchanges signals with a wellhead sensor, the wellhead sensor monitoring a hydraulic line with T-connection for bleed-off and the transceiver communicating with the wellhead sensor through a first communication link established by the smart device, a localization system that identifies pressure information relating to information of the well, the information including a size of an inner casing and a size of an outer casing of the well, and a processor that implements a combination of artificial intelligence and machine learning to pre-emptively provide warnings relating to possible estimated CCA behavior. The combination of artificial intelligence and machine learning generates report information that includes whether a source from a bleed-off is downhole or from trapped compressed fluid due to heat expansion, and the report information provides a forward plan for a remedial job if required based on previous history of similar CCA behavior in the well.

In general, in one aspect, embodiments disclosed herein relate to a smart system located in a wellbore head during production operations of a well. The smart system includes a wellhead sensor that monitors a hydraulic line with T-connection for bleed-off, and collects information of the well including a size of an inner casing and a size of an outer casing of the well, and a smart device. The smart device includes a transceiver that exchanges signals with the wellhead sensor, the transceiver communicating with the wellhead sensor through a first communication link established by the smart device, a localization system that identifies pressure information relating to the pressure information, and a processor that implements a combination of artificial intelligence and machine learning to pre-emptively provide warnings relating to possible estimated CCA behavior. The combination of artificial intelligence and machine learning generates report information that includes whether a source from a bleed-off is downhole or from trapped compressed fluid due to heat expansion, and the report information provides a forward plan for a remedial job if required based on previous history of similar CCA behavior in the well.

In general, in one aspect, the invention relates to a method for diagnosing Casing-Casing Annulus (CCA) behavior using a smart system located in a wellbore head during production operations in a well. The method involves monitoring, by a wellhead sensor, a hydraulic line with T-connection for bleed-off, obtaining pressure information of the well, the pressure information including a size of an inner casing and a size of an outer casing of the well, and using a smart device configured to implement a combination of artificial intelligence and machine learning to pre-emptively provide warnings relating to possible estimated CCA behavior. The combination of artificial intelligence and machine learning generates report information that includes whether a source from a bleed-off is downhole or from trapped compressed fluid due to heat expansion, and the report information provides a forward plan for a remedial job if required based on previous history of similar CCA behavior in the well.

Other aspects of the disclosure will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure include a smart device, a smart system, and a method for diagnosing Casing-Casing Annulus (CCA) behavior using a smart system located in a wellbore head during production operations in a well. The smart device, the smart system, and the method identify and differentiate whether CCA pressure may be prevented in a specific well. The smart device obtains information about a source in the formation or heat expansion of compressed fluid due to temperature. The smart system is connected to a side-outlet valve of a wellhead that has annulus pressure information from the specific well. The smart device determines CCA issues based on pressure build up rate and behavior and has the capability to identify whether the pressure is from a downhole source such as reservoir or expansion of trapped fluid. Identifying the source of pressure build-up in casing annuli is a crucial step in order to set up the proper remedial plan. The system is built based on a machine learning and artificial intelligent program capable of learning from the previous trends of the pressure build up and utilizing such historical data to identify the source of CCA issue in the affected well.

Figure 1:
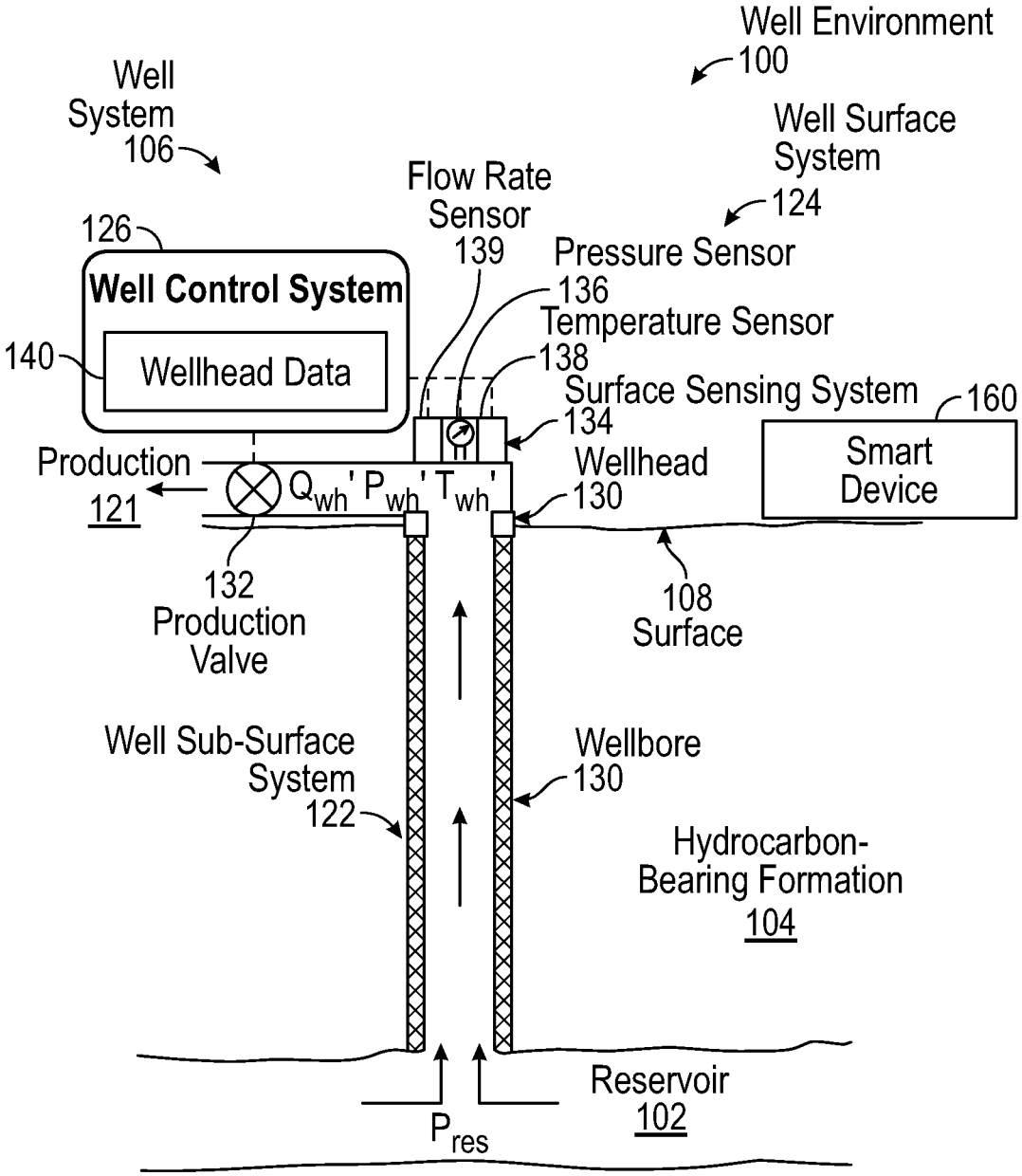
FIG. 1 shows a schematic diagram showing a production well of a smart system including a smart device in accordance with one or more embodiments.

FIG. 1 shows a schematic diagram in accordance with one or more embodiments. More specifically, FIG. 1 illustrates a well environment 100 that includes a hydrocarbon reservoir ("reservoir") 102 located in a subsurface formation ("formation") 104 and a well system 106. The formation 104 may include a porous formation that resides underground, beneath the Earth's surface ("surface") 108. In the case of the well system 106 being a hydrocarbon well, the reservoir 102 may include a portion of the formation 104. The formation 104 and the reservoir 102 may include different layers (referred to as subterranean intervals or geological intervals) of rock having varying characteristics, such as varying degrees of permeability, porosity, capillary pressure, and resistivity. In other words, a subterranean interval is a layer of rock having consistent permeability, porosity, capillary pressure, resistivity, and/or other characteristics. For example, the reservoir 102 may be an unconventional reservoir or tight reservoir. In the case of the well system 106 being operated as a production well, the well system 106 may facilitate the extraction of hydrocarbons (or "production") from the reservoir 102.

In some embodiments, the well system 106 includes a wellbore 120, a well sub-surface system 122, a well surface system 124, and a well control system ("control system") 126. The control system 126 may control various operations of the well system 106, such as well production operations, well completion operations, well maintenance operations, and reservoir monitoring, assessment and development operations. In some embodiments, the control system 126 includes a computer system that is the same as or similar to that of computer system 1000 described below in FIG. 10 and the accompanying description.

The wellbore 120 may include a bored hole that extends from the surface 108 into a target zone (i.e., a subterranean interval) of the formation 104, such as the reservoir 102. An upper end of the wellbore 120, terminating at or near the surface 108, may be referred to as the "up-hole" end of the wellbore 120, and a lower end of the wellbore, terminating in the formation 104, may be referred to as the "down-hole" end of the wellbore 120. The wellbore 120 may facilitate the circulation of drilling fluids during drilling operations, the flow of hydrocarbon production ("production") 121 (e.g., oil and gas) from the reservoir 102 to the surface 108 during production operations, the injection of substances (e.g., water) into the formation 104 or the reservoir 102 during injection operations, or the communication of monitoring devices (e.g., logging tools) into the formation 104 or the reservoir 102 during monitoring operations (e.g., during in situ logging operations). For example, the logging tools may include logging-while-drilling tool or logging-while-tripping tool for obtaining downhole logs.

In some embodiments, during operation of the well system 106, the control system 126 collects and records wellhead data 140 for the well system 106. The wellhead data 140 may include, for example, a record of measurements of wellhead pressure (Pwh) (e.g., including flowing wellhead pressure), wellhead temperature (Twh) (e.g., including flowing wellhead temperature), wellhead production rate (Qwh) over some or all of the life of the well 106, and water cut data. In some embodiments, the measurements are recorded in real-time, and are available for review or use within seconds, minutes, or hours of the condition being sensed (e.g., the measurements are available within 1 hour of the condition being sensed). In such an embodiment, the wellhead data 140 may be referred to as "real-time" wellhead data 140. Real-time wellhead data 140 may enable an operator of the well 106 to assess a relatively current state of the well system 106, and make real-time decisions regarding development of the well system 106 and the reservoir 102, such as on-demand adjustments in regulation of production flow from the well.

In some embodiments, the well sub-surface system 122 includes casing installed in the wellbore 120. For example, the wellbore 120 may have a cased portion and an uncased (or "open-hole") portion. The cased portion may include a portion of the wellbore having casing (e.g., casing pipe and casing cement) disposed therein. The uncased portion may include a portion of the wellbore not having casing disposed therein. In embodiments having a casing, the casing defines a central passage that provides a conduit for the transport of tools and substances through the wellbore 120. For example, the central passage may provide a conduit for lowering logging tools into the wellbore 120, a conduit for the flow of production 121 (e.g., oil and gas) from the reservoir 102 to the surface 108, or a conduit for the flow of injection substances (e.g., water) from the surface 108 into the formation 104. In some embodiments, the well sub-surface system 122 includes production tubing installed in the wellbore 120. The production tubing may provide a conduit for the transport of tools and substances through the wellbore 120. The production tubing may, for example, be disposed inside casing. In such an embodiment, the production tubing may provide a conduit for some or all of the production 121 (e.g., oil and gas) passing through the wellbore 120 and the casing.

In some embodiments, the well surface system 124 includes a wellhead 130. The wellhead 130 may include a rigid structure installed at the "up-hole" end of the wellbore 120, at or near where the wellbore 120 terminates at the Earth's surface 108. The wellhead 130 may include structures (called "wellhead casing hanger" for casing and "tubing hanger" for production tubing) for supporting (or "hanging") casing and production tubing extending into the wellbore 120. Production 121 may flow through the wellhead 130, after exiting the wellbore 120 and the well sub-surface system 122, including, for example, the casing and the production tubing. In some embodiments, the well surface system 124 includes flow regulating devices that are operable to control the flow of substances into and out of the wellbore 120. For example, the well surface system 124 may include one or more production valves 132 that are operable to control the flow of production 121. For example, a production valve 132 may be fully opened to enable unrestricted flow of production 121 from the wellbore 120, the production valve 132 may be partially opened to partially restrict (or "throttle") the flow of production 121 from the wellbore 120, and production valve 132 may be fully closed to fully restrict (or "block") the flow of production 121 from the wellbore 120, and through the well surface system 124.

In some embodiments, the wellhead 130 includes a choke assembly. For example, the choke assembly may include hardware with functionality for opening and closing the fluid flow through pipes in the well system 106. Likewise, the choke assembly may include a pipe manifold that may lower the pressure of fluid traversing the wellhead. As such, the choke assembly may include set of high pressure valves and at least two chokes. These chokes may be fixed or adjustable or a mix of both. Redundancy may be provided so that if one choke has to be taken out of service, the flow can be directed through another choke. In some embodiments, pressure valves and chokes are communicatively coupled to the well control system 126. Accordingly, a well control system 126 may obtain wellhead data regarding the choke assembly as well as transmit one or more commands to components within the choke assembly in order to adjust one or more choke assembly parameters.

Keeping with FIG. 1, in some embodiments, the well surface system 124 includes a surface sensing system 134. The surface sensing system 134 may include sensors for sensing characteristics of substances, including production 121, passing through or otherwise located in the well surface system 124. The characteristics may include, for example, pressure, temperature and flowrate of production 121 flowing through the wellhead 130, or other conduits of the well surface system 124, after exiting the wellbore 120.

In some embodiments, the surface sensing system 134 includes a surface pressure sensor 136 operable to sense the pressure of production 121 flowing through the well surface system 124, after it exits the wellbore 120. The surface pressure sensor 136 may include, for example, a wellhead pressure sensor that senses a pressure of production 121 flowing through or otherwise located in the wellhead 130. In some embodiments, the surface sensing system 134 includes a surface temperature sensor 138 operable to sense the temperature of production 121 flowing through the well surface system 124, after it exits the wellbore 120. The surface temperature sensor 138 may include, for example, a wellhead temperature sensor that senses a temperature of production 121 flowing through or otherwise located in the wellhead 130, referred to as "wellhead temperature" (Twh). In some embodiments, the surface sensing system 134 includes a flowrate sensor 139 operable to sense the flowrate of production 121 flowing through the well surface system 124, after it exits the wellbore 120. The flowrate sensor 139 may include hardware that senses a flowrate of production 121 (Qwh) passing through the wellhead 130.

Prior to completing the well system 106 or for identifying candidate locations to drill a new well, hydrocarbon reserves may be estimated to evaluate the economic potential of completing the formation drilling to access an oil or gas reservoir, such as the reservoir 102. Estimating the hydrocarbon reserve of a tight reservoir is particularly important due to the expense of hydraulic fracturing operations necessary to produce hydrocarbons. The well system 106 further includes a smart device 160. In one or more embodiments, the smart device 160 may include hardware and/or software with functionality to analyze the well log data, the core sample data, and/or other types of data to generate and/or update one or more reservoir models and corresponding hydrocarbon reserve estimates of the reservoir 102. For example, the smart device 160 may be a computer, a tablet, a smart phone, or any other suitable device with processing power and memory. The smart device 160 is further configured to identify parameters associated with Casing-Casing Annulus (CCA) behavior based on one or more parameters tracked in relation to the status of the well system 106. In some embodiments, the smart device 160 may include software configured with machine learning capabilities and artificial intelligence (AI) that learn from trends of the one or more parameters tracked by the control system 126.

In one or more embodiments, the AI and machine learning (ML) capabilities employed by the smart device may include any suitable algorithms and processes for predicting well behavior using historical data as input. For example, the ML models or algorithms may include supervised algorithms, unsupervised algorithms, deep learning algorithms that use artificial neural networks (ANN), etc. More specifically, supervised ML models include classification, regression models, etc. Unsupervised ML models include, for example, clustering models. Deep-learning algorithms are a part of ML algorithms based on artificial neural networks with representation learning. For example, the deep-learning algorithm may run data through multiple layers of neural network algorithms, each of which passes a simplified representation of the data to the next layer. With respect to neural networks, for example, a neural network may include one or more hidden layers, where a hidden layer includes one or more neurons. A neuron may be a modelling node or object that is loosely patterned on a neuron of the human brain. In particular, a neuron may combine data inputs with a set of coefficients, i.e., a set of network weights and biases for adjusting the data inputs. These network weights and biases may amplify or reduce the value of a particular data input, thereby assigning an amount of significance to various data inputs for a task being modeled. Through machine learning, a neural network may determine which data inputs should receive greater priority in determining one or more specified outputs of the neural network. Likewise, these weighted data inputs may be summed such that this sum is communicated through a neuron's activation function to other hidden layers within the neural network. As such, the activation function may determine whether and to what extent an output of a neuron progresses to other neurons where the output may be weighted again for use as an input to the next hidden layer.

In some embodiments, a machine-learning model may include an encoder model that transforms input data to a latent representation vector. The machine-learning model may further amalgamate the latent representation vector with a vector representation of a particular parameterization to produced combined data, e.g., using in a latent space domain. Likewise, the machine-learning model may also include a decoder model that transforms the combined vector into the corresponding output data according to the parameterization.

In some embodiments, the machine-learning model is a variational autoencoder. For example, variational autoencoders may compress input information into a constrained multivariate latent distribution through encoding in order to reconstruct the information during a decoding process. Thus, variational autoencoders may be used in unsupervised, semi-supervised, and/or supervised machine-learning algorithms. More specifically, variational autoencoders may perform a dimensionality reduction that reduces the number of features within an input dataset (such as an input gather). This dimensionality reduction may be performed by selection (e.g., only some existing features are preserved) or by extraction (e.g., a reduced number of new features are produced from preexisting features). Thus, an encoder process may compress the input data (i.e., from an initial space to an encoded space or latent space), while a decoder process may decompress the compressed data. This compression may be lossy, such that a portion of the original information in the input dataset cannot be recovered during the decoding process.

In some embodiments, various types of machine learning algorithms may be used to train the model that is used to predict CCA behavior in new wells, such as a backpropagation algorithm. In a backpropagation algorithm, gradients are computed for each hidden layer of a neural network in reverse from the layer closest to the output layer proceeding to the layer closest to the input layer. As such, a gradient may be calculated using the transpose of the weights of a respective hidden layer based on an error function (also called a "loss function"). The error function may be based on various criteria, such as mean squared error function, a similarity function, etc., where the error function may be used as a feedback mechanism for tuning weights in the electronic model.

Figure 2:
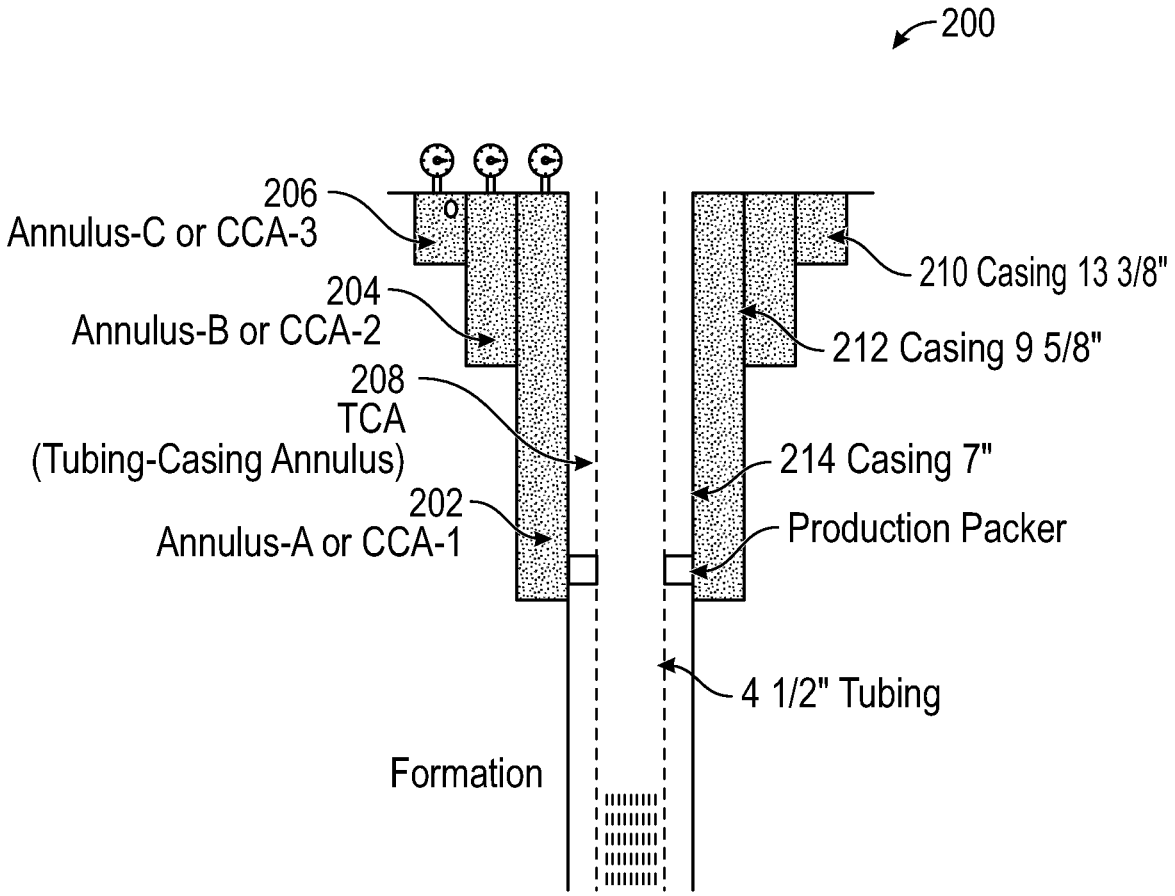
FIG. 2 shows a cross-section view of a casing installation in accordance with one or more embodiments.

FIG. 2 shows a cross-section view 200 of multiple annuli (e.g., Annulus-A (202), Annulus-B (204), Annulus-C (206), tubing-casing Annulus (208)) adjacent to one another and monitored using dedicated valves coupled to the smart device 160 in accordance to one or more embodiments. In some embodiments, the pressure in-between the casings (e.g., 210, 212, 214) is measured by surfaces gauges assembled at the wellhead 130. CCA pressure may be developed due to cement failure and communication from a source such as a downhole formation or trapped fluid in the cement due to heat expansion. In both cases where CCA is developed, the communication may occur when there is cement failures due to micro-channeling or micro-annulus.

In one or more embodiments, CCA pressure may be reduced by bleeding-off the current pressure, wait, and monitor the ongoing pressure. Once the pressure bleeds-off, the smart device 160 prevents samples of influent from being sent to a lab for chemical analysis of the fluid content. In this regard, pressure build-up rate, if any, may be monitored and analyzed to identify a source of the fluid. Once CCA pressure is expected or identified, the smart device may generate a workover order to prevent CCA pressure issues.

Figure 3:
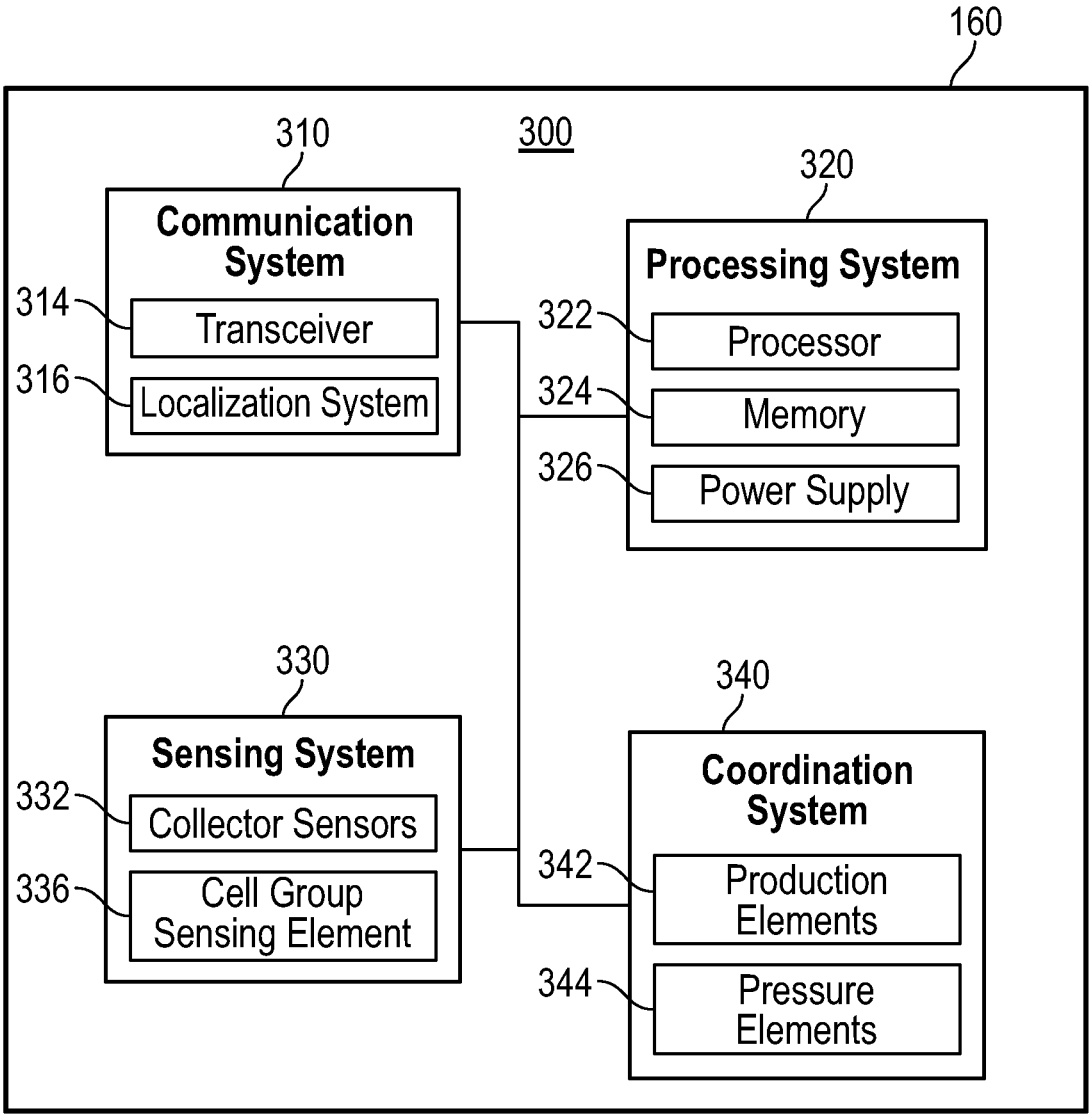
FIG. 3 shows a schematic diagram representative of a smart device in accordance with one or more embodiments.

FIG. 3 shows a schematic diagram illustrating various systems disposed in the smart device 160. In some embodiments, the smart device 160 is located at a distance from the wellhead 130. The smart device 160 may be defined by a housing 300 rated for use in hazardous environments. During production operations, the smart device 160 may start autonomously upon detecting a triggering condition. The triggering condition may result from comparing predetermined casing properties with a specific set of data collected by one or more systems of the smart device 160. In this regard, casing monitoring performed by the smart device 160 may be automatically activated upon identifying that the predetermined casing properties have been met. These casing properties may include information relating to changes in the CCA pressure.

Upon activation, the smart device 160 may identify CCA issues by diagnosing a problem in the well system 106 and identifying a source of any CCA pressure. The smart device 160 identifies a level of the complication of the CCA issues. At this point, the smart device 160 reduces the diagnosing process through identifying the source of the CCA pressure. As noted above, the source of the CCA pressure may be from a downhole reservoir or from trapped pressure. The smart device 160 determines a workover plan based on the source of the CCA pressure. Through the use of machine learning and artificial intelligence, the smart device 160 uses historical data relating to the well system 106.

In some embodiments, the smart device 160 is completely enclosed in the housing 300 containing a communication system 310, a processing system 320, a sensing system 330, and a coordination system 340. The communication system 310 may include communication devices such as a transceiver 314, and a localization system 316. The transceiver 314 may transmit and receive communication signals. Specifically, the transceiver 314 may communicate with one or more control systems located at a remote location. The transceiver 314 may communicate wirelessly using a wide range of frequencies and by establishing multiple communication links. In some embodiments, high or ultrahigh frequencies (i.e., between 10 KHz to 10 GHz) may be implemented. The localization system 316 may include one or more geospatial location identification components that collect information associated with a geospatial location of casing-casing interactions within the well system 106 with respect to the center of the wellbore 130.

The processing system 320 may include a processor 322, a memory 324, and a power supply 326. The power supply 326 may be a battery or wired connection for providing electrical energy to the smart device 160. In some embodiments, the battery is charged using electrical connectors (not shown). The processor 322 may perform computational processes simultaneously and/or sequentially. The processor 322 may determine information to be transmitted and processes to be performed using information received or collected. Similarly, the processor 322 may control collection and exchange of geospatial information through the localization system 316.

As noted above, the processor 322 may perform real-time analysis of the casing during the production operations in real-time. The processor 322 may generate at least one workover report representative of rig workover solutions. The workover reports may be processed by an evaluation engine that will be explained in more detail with respect to FIG. 6. The processor 322 may compare a status of the CCA pressure with multiple predetermined casing properties. The multiple predetermined casing properties may include several parameters associated with workover diagnosis processes. The processor 322 may trigger the triggering condition when the status of the CCA pressure equals at least one casing property out of the multiple predetermined casing properties. Further, the memory 324 may store stores the at least one workover report by indexing the one or more casing properties identified based on bleed-off information and casing condition statuses.

The sensing system 330 may include collector sensors 332 and a cell group sensing element 336. The collector sensors 332 may be sensors that collect physical data from the environment surrounding the smart device 160 (i.e., the rock formation and/or the surface). The collector sensors 332 may be sensors that collect physical data from the smart device 160 itself (i.e., internal temperature, internal pressure, or internal humidity). The collector sensors 332 may be lightweight sensors requiring a small footprint. These sensors may monitor a status of the CCA pressure during the production operations. These sensors may exchange information with each other and supply it to the processor 322 for analysis. The cell group sensing element 336 may be a logging tool of an electrical type that establishes communication links with one or more additional devices disposed on the surface or at a remote location. The cell group sensing element 336 may identify trends, characteristics or properties (i.e., such as pressure or temperature changes) relating to the movement of the smart device 160 in relation to the well system 130. The cell group sensing element 336 may stabilize communications associated with the transceiver 314 by preventing magnetic interference between the transceiver 314 and the rest of the smart device 160. The power supply 326 may be operationally connected to the cell group sensing system 336 and including connections (not shown) for collecting energy and producing electrical energy as a result.

The coordination system 340 may include production elements 342 and pressure elements 344. The production elements 342 may include valves and peripherals associated with hydrocarbon production. The pressure elements 344 may be mechanisms that identify and track the positioning of the CCA pressure and bleed-off with respect to one or more instructions indicated for the workover of the well system 106.

Figure 4:
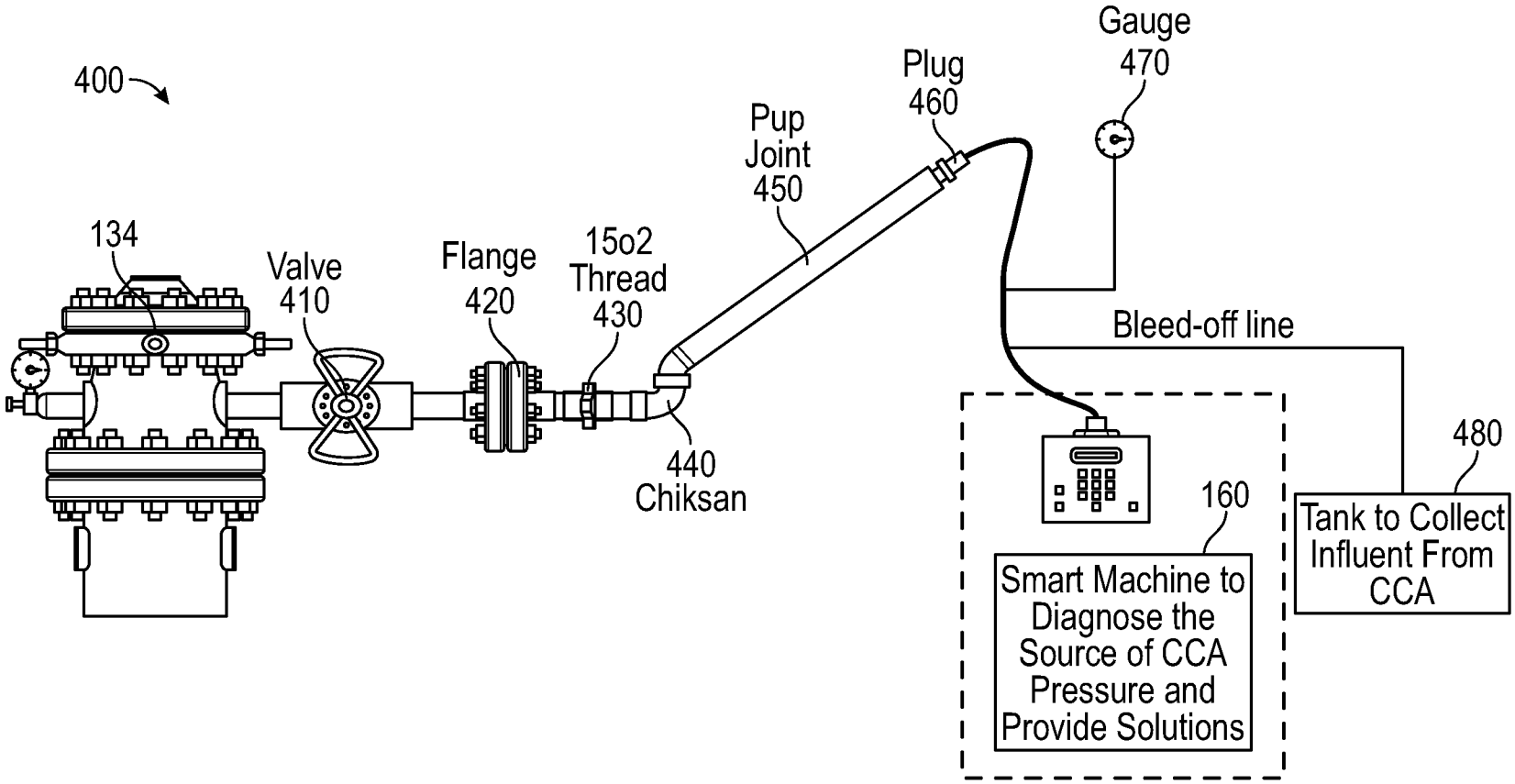
FIG. 4 shows a schematic diagram representative of a smart system in accordance with one or more embodiments.

FIG. 4 shows a perspective view of a smart system 400 including the smart device 160 during a monitoring function. The smart system 400 may operate in connection with the surface sensing system 134 through a plurality of physical connections. In some embodiments, the surface sensing system 134 is directly connected to an output valve 410 and followed by a flange 420 interconnected with a joint 430 and a loading arm 440 (i.e., chiksan) coupled to a first end of a pup joint 450. Further, a second end of the pup joint 450 may be directly connected to a plug 460 coupled to bleed-off gauge 470 before reaching the smart device 160. The bleed-off may traverse all the way to the plug 460 and a tank 480 to collect influent from CCA pressure in parallel to the smart device 160. In this case, the parallel collection is performed for the smart device 160 to diagnose a source of CCA pressure and provide solutions.

In some embodiments, the output valve 410 is connected to the flange 420 that connects pipes, valves, pumps, and other equipment to form a piping system. The flange 420 also provides easy access for cleaning, inspection, or modification in the piping system. The flange 420 may be welded or screwed. Flanged joints may be made by bolting together two flanges with a gasket between them to provide a seal.

In some embodiments, the loading arm 440 is coupled to the first end of the pup joint 450, which is a pipe of non-standard length used to adjust the length of tubular strings to its exact requirement.

Figure 5:
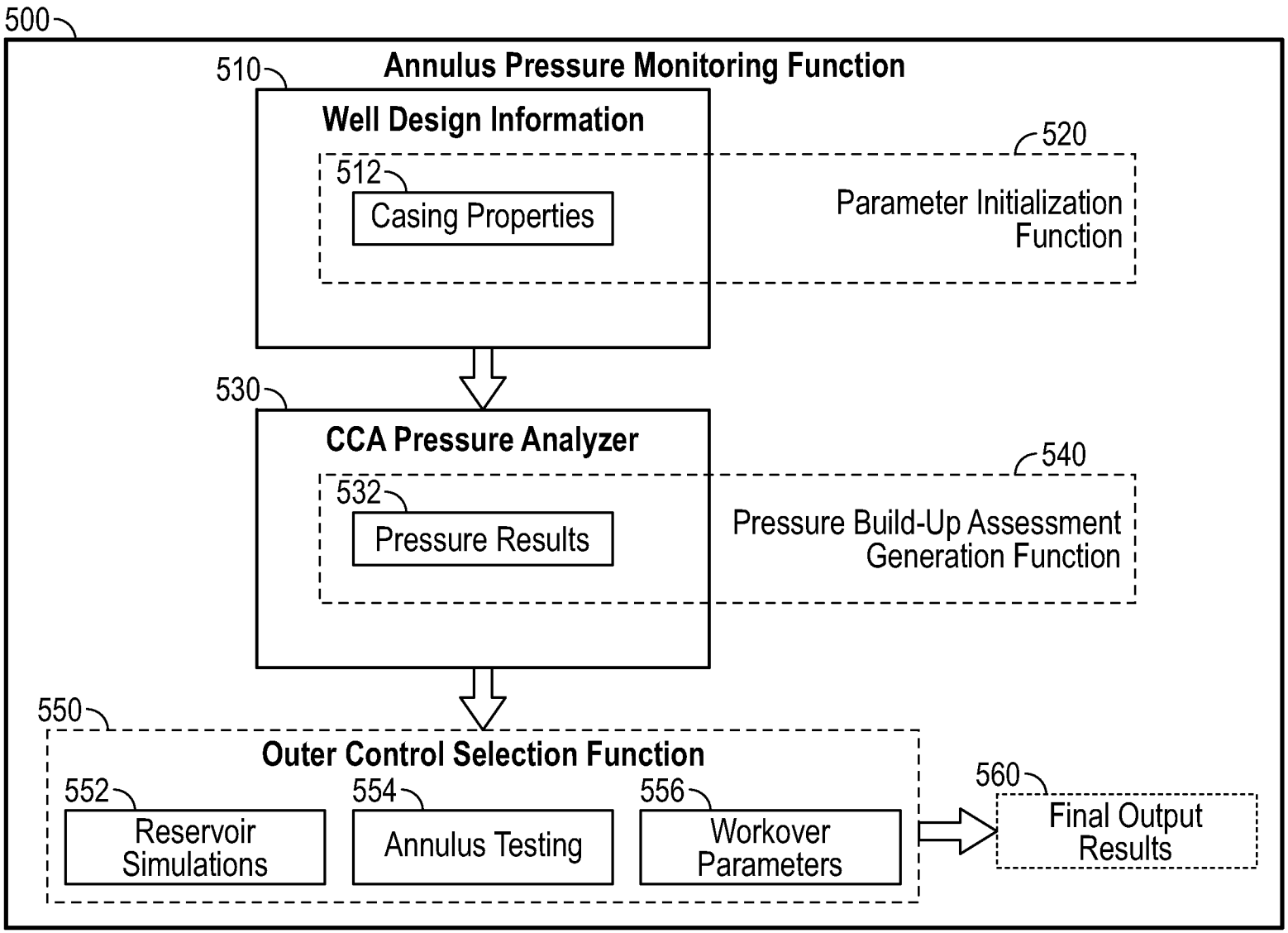
FIG. 5 shows a schematic diagram of a method for reporting workover solutions for CCA behavior in accordance with one or more embodiments.

FIG. 5 illustrates a successive flow of parameters implemented in monitoring an annulus pressure of a well by an annulus pressure monitoring function 500. The annulus pressure monitoring function 500 may be hardware and/or software configured to monitor the pressure in the annulus of the hydrocarbon well. In FIG. 5, the annulus pressure monitoring function 500 may be implemented by one or more devices described in reference to numeral 100 of FIG. 1, in reference to the smart device 160 of FIGS. 1-4, or in reference to the computer system 1000 of FIG. 7. For example, the annulus pressure monitoring function 500 may be implemented in the processing 320 or coordination system 340 of the smart device 160 shown in FIG. 3. In some embodiments, the annulus pressure monitoring function 500 identifies well design information 510 (i.e., swell construction information) including casing properties 512 for using in a parameter initialization function 520 of an area of interest. The area of interest is any casing portion or section of a wellbore in which communication may be identified. In some embodiments, the method and the system perform periodic surveys to monitor an annulus pressure of the well in the area of interest.

In the parameter initialization function 520, the parameters associated with the well design information 510 are selected based on their relevance. The parameter initialization function 520 may share processing with a build-up assessment generation function 540, which controls a CCA pressure analyzer 530 indicating a pressure results 532 in which an iterative loop determines a number of required pressure results. The iterative loop is a representation of the repetitive process to evaluate subsequent parameters based on the periodic surveys on the annulus until a final time of the iterations is reached. The iterative loop is implemented by the combination of the machine learning algorithm and the artificial intelligence algorithm. The final time may be controlled by hardware or software of the annulus pressure monitoring function 500.

Once the CCA pressure analyzer 530 processes the pressure results 532, an output control selection function 550 may perform processing of the initialized parameters to perform fluid return determination 552, perform annulus testing 554, and update workover parameters 558. As a result, final output results 560 may be obtained for instructing the implementation of remedial actions or workover operations. To this end, the annulus pressure monitoring function 500 may provide the possibility to generate decisions as to any workover instructions to based on the best course of action to prevent future CCA issues.

FIG. 5 illustrates a successive flow of parameters implemented in monitoring an annulus pressure of a well by the annulus pressure monitoring function 500. FIG. 5 expands on the functions of the CCA pressure analyzer 530 and the smart device 160 from FIG. 3. In one or more embodiments, the method identifies and selects workover to be implemented in the well. Workover candidate wells are wells that are identified as having sustained casing pressure for offshore/onshore hydrocarbon wells during well operational phases and a shutdown condition. In some embodiments, the annulus pressure monitoring function 500 generates the decision that recommends a proper workover plan with the best remedial action programs.

The annulus pressure monitoring function 500 alerts operators with a proper mitigation plan when communication is identified. In some embodiments, the annulus pressure monitoring function 500 is used as a tool to develop a strategy for upcoming workover programs. According to one or more embodiments, providing alerts for proper mitigation plans without required sustained downtime for the well, maintains well integrity and safety, maintains well productivity, maximizes well operation life, identifies CCA problems, resolves any uncertainty related to well integrity conditions, provides a cost-effective approach without downhole intervention, prevents oil spill and environment impact, prevents risks related to well blowout and assets damage, prevents underground fluid invasion into water aquifer, avoids downhole cross flow between multi-oil bearing reservoir, prevents formation damage due to dumping water into oil bearing reservoirs, and minimizes hydrocarbon leaks that may jeopardize a production platform.

Figure 6:
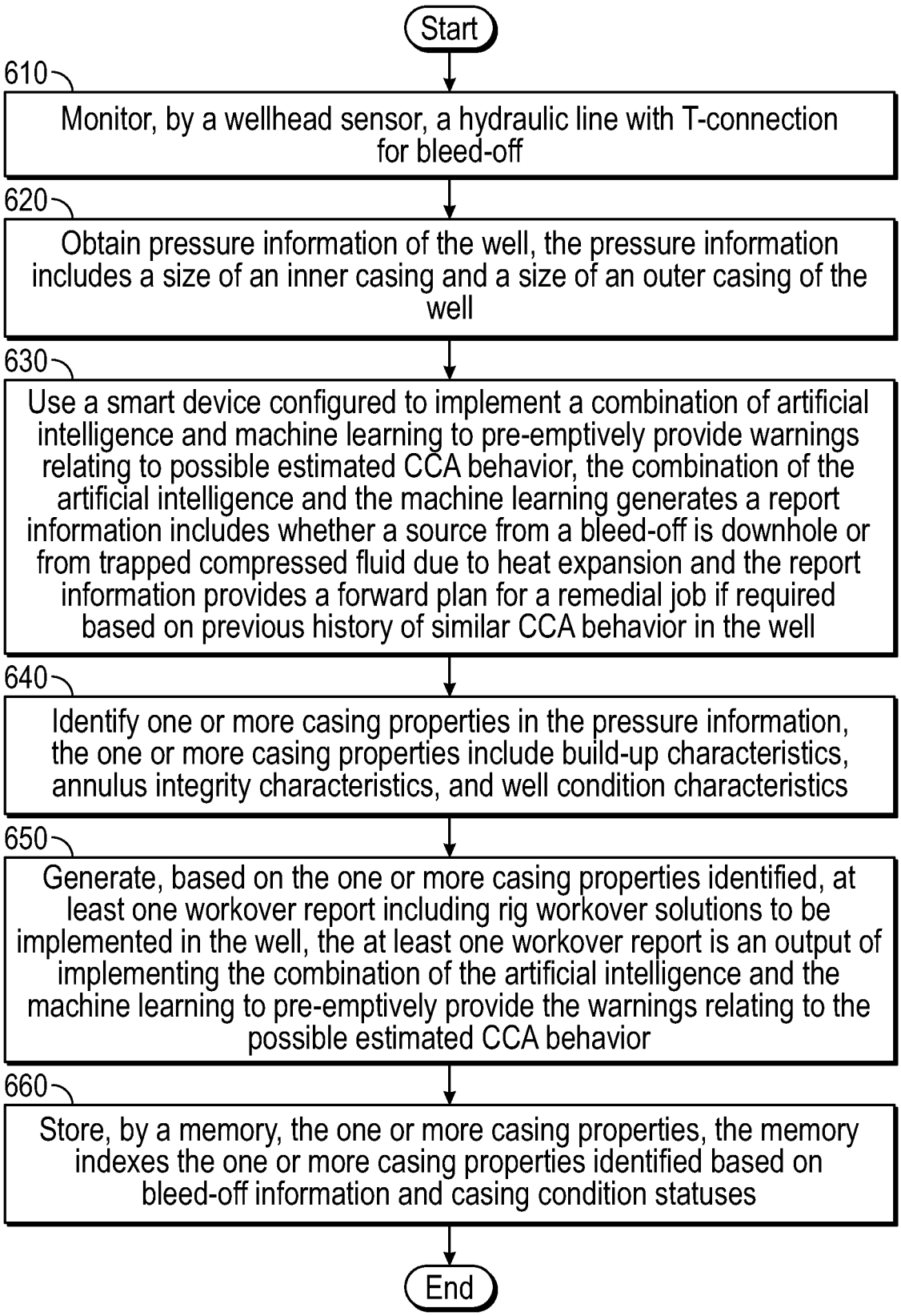
FIG. 6 shows a flowchart in accordance with one or more embodiments.

FIG. 6 shows a flowchart in accordance with one or more embodiments. Specifically, FIG. 6 describes a method for diagnosing Casing-Casing Annulus (CCA) behavior using a smart system located in a wellbore head during production operations in a well. In some embodiments, the method may be implemented using the devices described in reference to FIGS. 1-4. While the various blocks in FIG. 6 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 610, a wellhead sensor monitors a hydraulic line with T-connection for bleed-off.

In Block 620, pressure information of the well is obtained. The pressure information includes assize of an inner casing and a size of an outer casing of the well. In addition, other information about the well may also be obtained such as, for example, weight of the cement, top of the cement, reservoir pressure in the open hole, reservoir fluid, cement free water percentage (%), cement bond information from cement bond log, etc.

In Block 630, a smart device is used to provide commands and steps to the operator. The smart device is configured to implement a combination of artificial intelligence and machine learning to pre-emptively provide warnings to the operator relating to possible estimated CCA behavior. The combination of the artificial intelligence and the machine learning generates report information that includes whether a source from a bleed-off is downhole or from trapped compressed fluid due to heat expansion. The report information provides a forward plan for a remedial job if required based on previous history of similar CCA behavior in the well. Those skilled in the art will appreciate that Block 630 may be an iterative step in which the smart device monitors the pressure behavior of casing annuli of a well, provides commands to the operator to bleed-off pressure through the bleed-off line, and then the smart device starts to receive pressure build-up data from the well. This data is processed again by the smart device by applying machine learning on the received data. After that, the smart device provides commands to bleed off the pressure again or further steps required such as commands to collect samples, measure weight, and provide the type of fluid. This process may continue until the smart device has collected enough received data to provide information on whether the source of the pressure build-up is from downhole or from trapped compressed fluid due to heat expansion.

In Block 640, one or more casing properties are identified in the pressure information. The one or more casing properties include build-up characteristics, annulus integrity characteristics, and well condition characteristics.

In Block 650, at least one workover report is generated based on the one or more casing properties identified. The at least one workover report includes rig workover solutions to be implemented in the well. The at least one workover report is an output of implementing the combination of the artificial intelligence and the machine learning to pre-emptively provide the warnings relating to the possible estimated CCA behavior.

In Block 660, a memory stores the one or more casing properties. The memory indexes the one or more casing properties identified based on bleed-off information and casing condition statuses.

While FIGS. 1-6 show various configurations of components, other configurations may be used without departing from the scope of the disclosure. For example, various components in FIG. 1-5 may be combined to create a single component. As another example, the functionality performed by a single component may be performed by two or more components.

Figure 7:
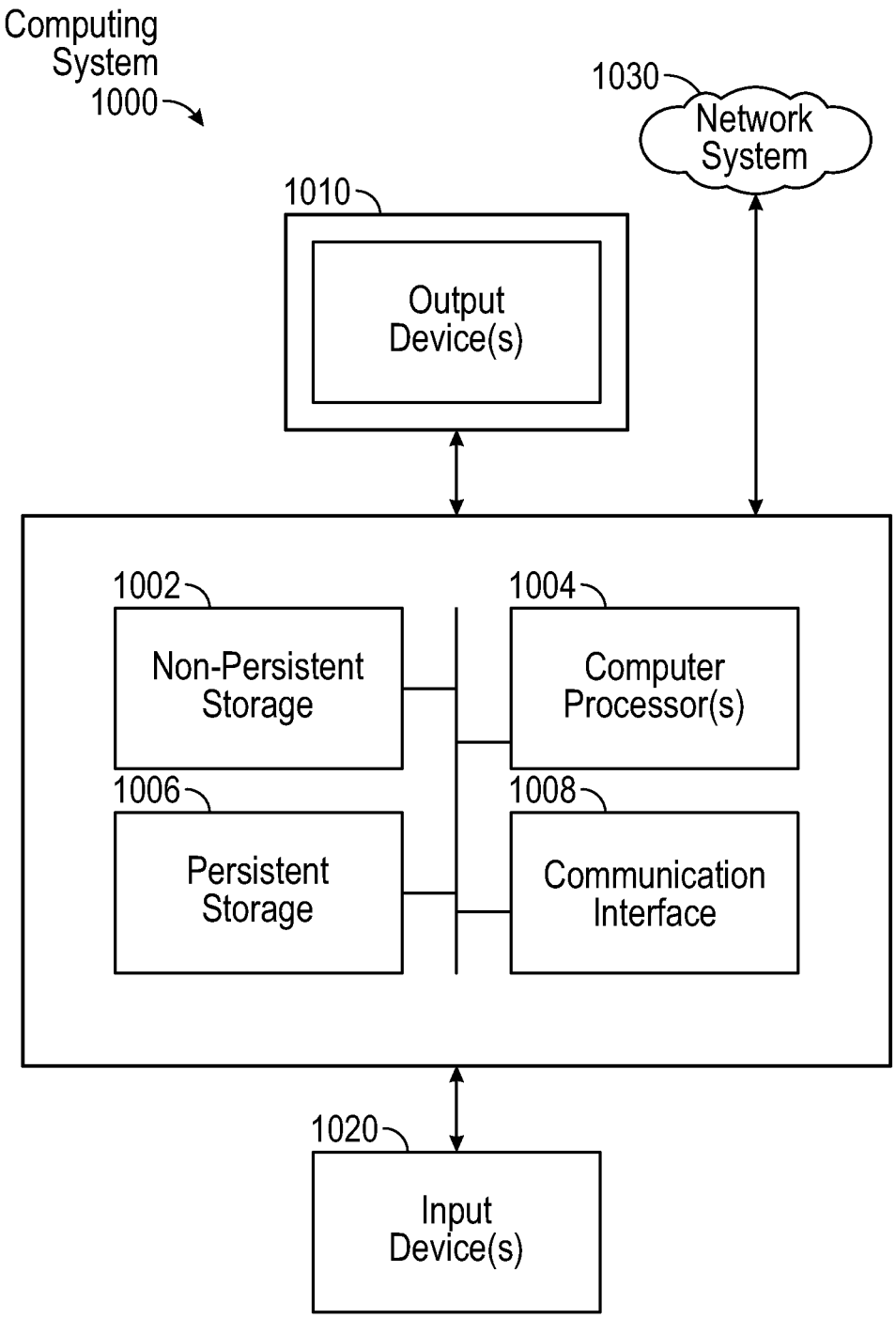
FIG. 7 shows an example of a computer system in accordance with one or more embodiments.

As shown in FIG. 7, the computing system 1000 may include one or more computer processor(s) 1004, non-persistent storage 1002 (e.g., random access memory (RAM), cache memory, or flash memory), one or more persistent storage 1006 (e.g., a hard disk), a communication interface 1008 (transmitters and/or receivers) and numerous other elements and functionalities. The computer processor(s) 1004 may be an integrated circuit for processing instructions. The computing system 1000 may also include one or more input device(s) 1020, such as a touchscreen, keyboard, mouse, microphone, touchpad, electronic pen, or any other type of input device. In some embodiments, the one or more input device(s) 1020 may be the well control system 126 described in reference to FIG. 1 connected to the smart device 160 described in reference to FIGS. 1 and 2. Further, the computing system 1000 may include one or more output device(s) 1010, such as a screen (e.g., a liquid crystal display (LCD), a plasma display, or touchscreen), a printer, external storage, or any other output device. One or more of the output device(s) may be the same or different from the input device(s). The computing system 1000 may be connected to a network system 1030 (e.g., a local area network (LAN), a wide area network (WAN) such as the Internet, mobile network, or any other type of network) via a network interface connection (not shown).

In one or more embodiments, for example, the input device 1020 may be coupled to a receiver and a transmitter used for exchanging communication with one or more peripherals connected to the network system 1030. The receiver may receive information relating to one or more reflected signals as described in reference to FIGS. 1-4. The transmitter may relay information received by the receiver to other elements in the computing system 1000. Further, the computer processor(s) 1004 may be configured for performing or aiding in implementing the processes described in reference to FIGS. 5-6.

Further, one or more elements of the computing system 1000 may be located at a remote location and be connected to the other elements over the network system 1030. The network system 1030 may be a cloud-based interface performing processing at a remote location from the well site and connected to the other elements over a network. In this case, the computing system 1000 may be connected through a remote connection established using a 5G connection, such as protocols established in Release 15 and subsequent releases of the 3GPP/New Radio (NR) standards.

The computing system in FIG. 7 may implement and/or be connected to a data repository. For example, one type of data repository is a database (i.e., like databases). A database is a collection of information configured for ease of data retrieval, modification, re-organization, and deletion. In some embodiments, the databases include published/measured data relating to the method, the systems, and the devices as described in reference to FIGS. 1-6.

While FIGS. 1-7 show various configurations of components, other configurations may be used without departing from the scope of the disclosure. For example, various components in FIGS. 1-5 and 7 may be combined to create a single component. As another example, the functionality performed by a single component may be performed by two or more components.

Embodiments disclosed herein provide a unique device to detect the source of any leak in CCA. While there are a lot of analysis and diagnostics just to pinpoint what could be the source of this leak, embodiments disclosed herein use AI and machine learning to plug in all the history from previous wells with CCA leaks or issues, and layer this data to understand the behavior of the new well, and predict the source of any CCA leaks based on the history.

While the disclosure has been described with respect to a limited number of embodiments, those skilled in the art, having benefit of this disclosure, will appreciate that other embodiments can be devised which do not depart from the scope of the disclosure as disclosed herein. Accordingly, the scope of the disclosure should be limited only by the attached claims.

What is claimed is:

1. A system comprising:

a plurality of casings corresponding to a plurality of casing annuli in a wellbore;

a wellhead that is installed at the wellbore and connected to the plurality of casings;

a side-outlet valve connected to the wellhead, wherein the side-outlet valve comprises a surface gauge that determines an annulus pressure of at least one annulus among the plurality of casing annuli in the wellbore;

a hydraulic line connected to the plurality of casing annuli and a tank, wherein the hydraulic line sends influent fluid content with T-connection for bleed-off from the plurality of casing annuli to the tank; and a smart device comprising a processor, a transceiver, and a memory, wherein the smart device is connected to the hydraulic line and is configured to:

determine a Casing-Casing Annulus (CCA) pressure build-up rate using the annulus pressure from the surface gauge, and determine, using a machine learning (ML) model, predicted CCA behavior based on the CCA pressure build-up rate, annulus integrity data, and well condition data, and pre-emptively provide one or more warnings relating to the predicted CCA behavior, wherein the predicted CCA behavior identifies a source of a CCA leak in the plurality of casings.

2. The smart system of claim 1, wherein the smart device is further configured to:

generate, based on the CCA pressure build-up rate, the annulus integrity data, and the well condition data, at least one workover report including rig workover solutions to be implemented in the wellbore, the at least one workover report being an output of implementing the ML model to pre-emptively provide the one or more warnings relating to the predicted CCA behavior.

3. The smart system of claim 2, wherein the memory stores the CCA pressure build-up rate, the annulus integrity data, and the well condition data, the memory indexing the CCA pressure build-up rate, the annulus integrity data, and the well condition data based on bleed-off information and one or more casing condition statuses.

4. The smart system of claim 1, wherein the smart device is further configured to:

establish a second communication link with a control system, transmit operation information of the wellbore to the control system, the control system performing data evaluation to determine whether build-up is forming in the wellbore, and receive one or more instruction signals from the control system, the one or more instruction signals including results from build-up testing based on the data evaluation.

5. The smart system of claim 1, the smart device further comprising:

a cell group sensing element that stabilizes communications associated with the transceiver by preventing interferences between the transceiver and the rest of the smart device.

6. A method comprising:

obtaining, using a side-outlet valve connected to a wellhead, an annulus pressure, wherein the side-outlet valve comprises a surface gauge that determines an annulus pressure of at least one annulus among the plurality of casing annuli in the wellbore, wherein the wellhead is installed at a wellbore and connected to a plurality of casings, and wherein the plurality of casings correspond to a plurality of casing annuli in the wellbore;

determine, using a smart device, a Casing-Casing Annulus (CCA) pressure build-up rate using the annulus pressure from the surface gauge, wherein the smart device comprises a processor, a transceiver, and a memory and is connected to a hydraulic line, wherein the hydraulic line is connected to the plurality of casing annuli and a tank, wherein the hydraulic line sends influent fluid content with T-connection for bleed-off from the plurality of casing annuli to the tank;

determine, using the smart device and a machine learning (ML) model, predicted CCA behavior based on the CCA pressure build-up rate, annulus integrity data, and well condition data; and pre-emptively, using the smart device, providing one or more warnings relating to the predicted CCA behavior, wherein the predicted CCA behavior identifies a source of a CCA leak in the plurality of casings.

7. The method of claim 6, further comprising:

generating, based on the CCA pressure build-up rate, the annulus integrity data, and the well condition data, at least one workover report including rig workover solutions to be implemented in the wellbore, the at least one workover report being an output of implementing the ML model to pre-emptively provide the one or more warnings relating to the predicted CCA behavior.

8. The method of claim 7, further comprising:

storing, by the memory, the CCA pressure build-up rate, the annulus integrity data, and the well condition data, the memory indexing the CCA pressure build-up rate, the annulus integrity data, and the well condition data based on bleed-off information and one or more casing condition statuses.

9. The method of claim 6, further comprising:

establishing a communication link with a control system, transmitting operation information of the wellbore to the control system, the control system performing data evaluation to determine whether build-up is forming in the wellbore, and receiving one or more instruction signals from the control system, the one or more instruction signals including results from build-up testing based on the data evaluation.

* * * * *